United States Patent [19]

Herr et al.

[11] 3,955,516

[45] May 11, 1976

[54] MAGNETIC ACTUATED SEWING MACHINE ZIGZAG MECHANISM

[75] Inventors: John A. Herr, Garwood; Wolfgang Jaffe, Roselle Park, both of N.J.

[73] Assignee: The Singer Company, New York, N.Y.

[22] Filed: Feb. 6, 1975

[21] Appl. No.: 547,687

[52] U.S. Cl. ..... 112/158 R; 112/221

[51] Int. Cl.[2] ..... D05B 3/02; D05B 55/14

[58] Field of Search ..... 112/157, 158 R, 158 E, 112/221, 220

[56] References Cited

UNITED STATES PATENTS

| | | | |
|---|---|---|---|
| 2,756,703 | 7/1956 | Perla et al. | 112/158 R |
| 3,039,323 | 6/1962 | Mori | 112/158 R X |
| 3,831,537 | 8/1974 | Siegel | 112/221 X |

*Primary Examiner*—H. Hampton Hunter

*Attorney, Agent, or Firm*—Edward L. Bell; Robert E. Smith; Marshall J. Breen

[57] ABSTRACT

There is disclosed a sewing machine having a needle bar gate vibrating mechanism whereby the sewing machine is adapted to produce zigzag stitches. The needle bar gate vibrating motion is obtained through the use of two spaced apart circular magnets mounted on a rotating shaft of the sewing machine and having disposed between them a pair of bar magnets operatively connected to the needle bar gate, the polarization of the magnets being such that one of the circular magnets exerts attractive force on the bar magnets while the other circular magnet exerts repulsive forces. As the shaft rotates these forces reverse, resulting in the imparting of vibratory motion to the needle bar gate.

5 Claims, 5 Drawing Figures

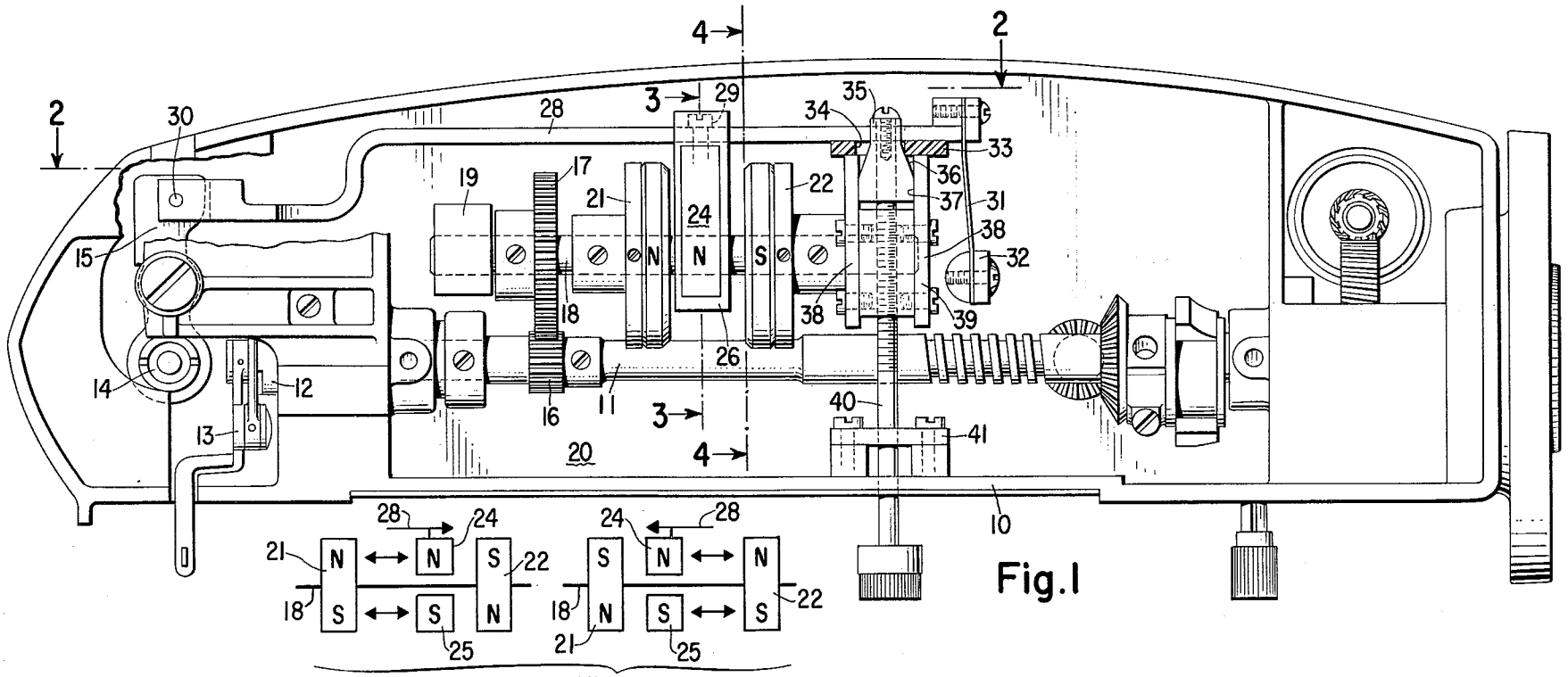
Fig.1
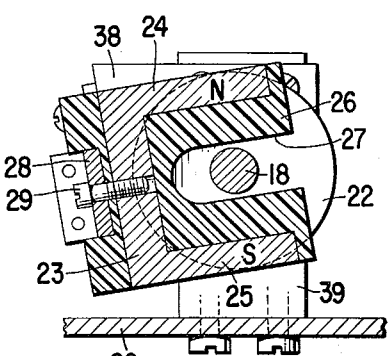
Fig.3
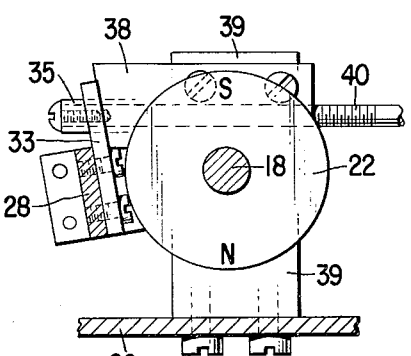
Fig.4
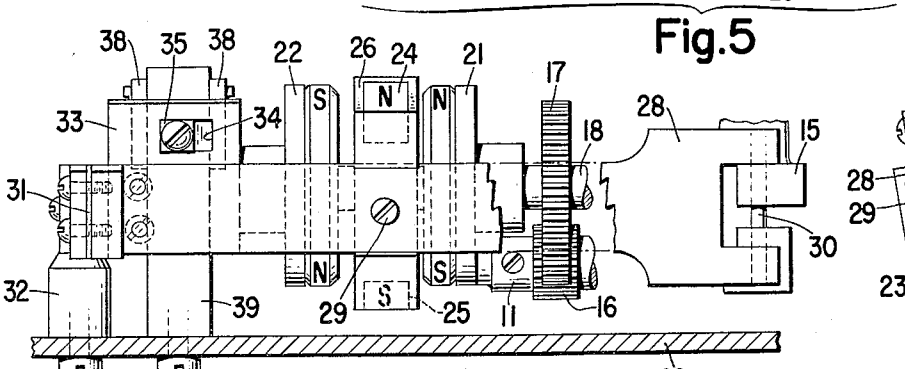
Fig.2
Fig.5

MAGNETIC ACTUATED SEWING MACHINE ZIGZAG MECHANISM

BACKGROUND OF THE INVENTION

It is well known to vibrate the needle bar gate of a sewing machine to effect zigzag stitching by means of a zigzag cam which is driven by a worm gear meshing with a continuously rotating worm. In such an arrangement a cam follower is connected, through rather complicated mechanism, to the needle bar gate and, in order to obtain the necessary stability of the needle bar and needle particularly during work penetration and at needle thread loop seizure by the looptaker, it is essential that the various elements included in the mechanism connecting the cam follower to the needle bar gate be made to close tolerances. Moreover, operation of the sewing machine causes wear on the parts of the needle vibrating mechanism and in due time this wear affects the quality of zigzag stitching.

SUMMARY OF THE INVENTION

It is the primary object of the present invention to provide a sewing machine needle vibrating mechanism in which the vibrating motion of the needle bar gate is obtained by the use of spaced rotating magnets having between them bar magnets operatively connected to the needle bar gate. The object of this invention is obtained by mounting a pair of circular magnets on a rotary shaft of a sewing machine in spaced relation and having their attracting poles (N-S) adjacent to each other. The space between the circular magnets accommodates preferably a shiftable U-shaped magnet that straddles the rotary shaft and is supported in this position by an insulating bracket secured to a driving member connected to the needle bar gate. The U-shaped magnet has its respective limbs of opposite polarity suspended between the circular magnets. In this fashion one of the circular magnets exerts attractive force on the bar magnet while the other circular magnet exerts repulsive forces. As the shaft rotates these forces reverse, resulting in back and forth motion of the driving member and thereby zigzag motion of the needle bar gate.

DESCRIPTION OF THE DRAWING

In the accompanying drawing, a preferred embodiment of this invention is illustrated in which:

FIG. 1 represents a top plan view of the bracket arm of a sewing machine with the top cover removed to disclose the mechanism within the bracket arm;

FIG. 2 is a rear elevational view taken substantially along line 2—2, FIG. 1;

FIG. 3 is a vertical sectional view taken substantially along line 3—3, FIG. 1;

FIG. 4 is a vertical sectional view taken substantially along line 4—4, FIG. 1 and FIG. 5 is a diagrammatic view of the magnet arrangement showing the manner in which the rotating magnets attract and repel the shiftable magnet.

DESCRIPTION OF A PREFERRED EMBODIMENT

Referring to FIG. 1 of the drawing, the bracket arm 10 of a sewing machine is illustrated in which is journaled a rotary arm shaft 11 having secured thereto a crank 12 that is operatively connected to actuate the needle thread take-up device 13 and endwise reciprocate the usual needle carrying bar 14. The needle bar

14 is reciprocated in a needle bar gate 15 which is fulcrumed in the machine frame so that the needle bar may be jogged or vibrated laterally to produce zigzag stitches. For a full disclosure of the mounting of the needle bar gate 15 reference may be had to the U.S. Pat. No. 2,989,016 dated June 20, 1961.

Driven from the arm shaft 11 through gears 16 and 17 is a jack shaft 18 journaled in bearings 19 formed on the bottom wall 20 of the bracket arm 10. Fastened on the jack shaft 18 are circular magnets 21 and 22 and, as shown best in FIG. 1, they are arranged so that their attracting poles (N-S) are opposite one another. Disposed in the space between magnets 21 and 22 is a U-shaped magnet 23 having an upper limb 24 and a lower limb 25, the limbs having opposite polarity, as shown in FIG. 3. The U-shaped magnet is fitted into an insulating block 26 which is slotted at 27 to straddle the jack shaft 18. The U-shaped magnet and the block 26 provide a shiftable magnet assembly. While the block 26 is illustrated as being made of plastic material it will be understood that any nonferrous material would be satisfactory.

As shown in FIG. 3, the block 26 is fastened to a drive link 28 by means of a screw 29 threaded into the magnet 23. The front end of the drive link is pivotally connected to the needle bar gate 15 through a pivot pin 30. The rear end of the drive link 28 is supported at its proper elevated position preferably by a leaf spring 31 secured at one end to a lug 32 provided on the bottom wall 20 of the bracket arm 10. The leaf spring 31 provides flexibility so that the drive link 28, under the forces exerted by the magnets 21, 22 and 23 during rotation of the jack shaft 18, can move longitudinally back and forth and thereby impart laterally jogging or vibrating movement to the needle bar gate 15.

Means are provided for controlling the extent of the endwise motion imparted to the drive link 28, and this means is best illustrated in FIG. 1. Secured to the inner face of the drive link is a small plate 33, preferably of plastic, having formed therein a slot 34 entered by a stop element 35 formed with tapered sides 36. The stop element 35 is slideably received in a guideway 37 formed between two guide members 38 secured on a support post 39 (FIG. 2) mounted on the bottom wall 20 of the bracket arm 10. The stop element is adapted to be moved in or out in its guideway by an adjusting screw 40 journaled freely in the stop element and threadedly mounted in the support post 39. Inside the front wall of the bracket arm 10 is a steady bearing provided by the plate 41, and the adjusting screw 40 is freely journaled in this bearing.

From the above description it will be understood that the manual turning of the adjusting screw 40 will shift the stop element relative to the plate 33 and, depending on the selected clearance existing between the ends of the slot 34 and the tapered sides 36 of the stop element, the amount of permitted endwise movement of the drive link can be controlled. Thus, the adjusting screw 40 is used to control the magnitude of vibrating movement imparted to the needle bar gate 15.

In the drawings the magnet 23 is shown as a permanet magnet. However, it will be understood that magnet 23 can be an electromagnet. An added advantage resulting from the use of an electromagnet would be that when the current is shut off the shiftable magnet would remain in its last attracted position. Thus, by controlling the on-off of the current the sewing machine could be made to produce a stitch pattern.

It will be appreciated that the needle bar gate vibration mechanism of the present invention is extremely simple in design, inexpensive to manufacture and assemble, and, in view of the limited number of moving parts, very little wear between the parts will occur. Another important advantage flowing from the present invention is that coaction between the magnets is such that endwise movement of the drive link 28 occurs in a very short time and this results in needle bar gate movement from one of its terminal positions to the other of its terminal positions while the needle is out of the work.

Numerous alterations of the structure herein disclosed will suggest themselves to those skilled in the art. However, it is to be understood that the present disclosure relates to a preferred embodiment of the invention which is for the purpose of illustration only and not to be construed as a limitation of the invention. All such modifications which do not depart from the spirit of the invention are intended to be included within the scope of the appended claims.

Having thus set forth the nature of the invention what is claimed herein is:

1. A needle bar gate vibrating mechanism for a sewing machine having a frame, a needle bar gate pivotally supported on said frame, a needle bar journaled in said needle bar gate, a main shaft journaled in said frame and operatively connected to actuate said needle bar, and a second shaft journaled in said frame and actuated at a speed less than the frequency of vibration of said needle bar gate, said mechanism including a pair of magnets mounted on said second shaft to rotate therewith and disposed in space relation with their attracting poles arranged opposite each other, shiftable magnet means located between said pair of magnets so as to be influenced by the reversing flux path of said rotating magnets, a driving connection operatively associated with said needle bar gate, and means for operatively connecting said shiftable magnet to said driving connection.

2. A needle bar gate vibrating mechanism for a sewing machine having a frame, a needle bar gate pivotally supported on said frame, a rotary arm shaft journaled in said frame, and a jack shaft driven from said arm shaft at one half the speed of said arm shaft, said mechanism including a pair of magnets mounted on said jack shaft to rotate therewith and disposed in spaced relation lengthwise of said jack shaft with their attracting poles arranged opposite each other, a drive link mounted in said frame for endwise movement, means connecting one end of the drive link to said needle bar gate, and a shiftable magnet assembly mounted on said drive link and extending between said spaced magnets with one of its poles on one side of the axis of the jack shaft and its other pole on the other side of the axis of the jack shaft.

3. A needle bar gate vibrating mechanism as set forth in Claim 2, wherein the shiftable magnet assembly is substantially U-shaped and disposed so that it straddles said jack shaft with its poles on opposite sides of the axis of said jack shaft.

4. A needle bar gate vibrating mechanism as set forth in Claim 2, wherein adjustable means are provided for controlling the magnitude of endwise motion impart by the drive link to the needle bar gate.

5. A needle bar gate vibrating mechanism as set forth in Claim 4, wherein the drive link is formed with a slot and the adjustable means for controlling the magnitude of the endwise motion of the drive link includes a stop element having tapered sides adapted to be engaged by the ends of the slot, and manually actuated screw means for adjusting the stop element relative to the drive link slot.

* * * * *